US007421873B2

(12) United States Patent
Kaimura et al.

(10) Patent No.: US 7,421,873 B2
(45) Date of Patent: Sep. 9, 2008

(54) ROLLING APPARATUS AND METHOD OF MAKING PRODUCT OF MISCELLANEOUS CROSS SECTION WITH USE OF SAME

(75) Inventors: Satoru Kaimura, Oyama (JP); Takashi Tamura, Oyama (JP)

(73) Assignee: Showa Denko K.K., Tokyo (JP)

( * ) Notice: Subject to any disclaimer, the term of this patent is extended or adjusted under 35 U.S.C. 154(b) by 259 days.

(21) Appl. No.: 10/557,840

(22) PCT Filed: May 18, 2004

(86) PCT No.: PCT/JP2004/007056

§ 371 (c)(1),
(2), (4) Date: Nov. 21, 2005

(87) PCT Pub. No.: WO2004/103590

PCT Pub. Date: Dec. 2, 2004

(65) Prior Publication Data

US 2006/0201220 A1 Sep. 14, 2006

Related U.S. Application Data

(60) Provisional application No. 60/478,346, filed on Jun. 16, 2003.

(30) Foreign Application Priority Data

May 20, 2003 (JP) ..... 2003-141562

(51) Int. Cl.
*B44B 5/00* (2006.01)

(52) U.S. Cl. ..... 72/197; 72/252.5

(58) Field of Classification Search ..... 72/194, 72/196, 197, 198, 240, 249, 252.5, 184, 191, 72/199

See application file for complete search history.

(56) References Cited

U.S. PATENT DOCUMENTS 3,686,917 A * 8/1972 Hikida et al. ..... 72/187
4,627,258 A * 12/1986 Loges et al. ..... 72/196
5,749,144 A 5/1998 Hirano et al.

(Continued)

FOREIGN PATENT DOCUMENTS

EP 0 781 610 A2 7/1997

(Continued)

*Primary Examiner*—Edward Tolan
(74) *Attorney, Agent, or Firm*—Oblon, Spivak, McClelland, Maier & Neustadt, P.C.

(57) ABSTRACT

A rolling apparatus including a first work roll and a second work roll cooperative with the first work roll for rolling a metal blank plate to manufacture a metal product of miscellaneous cross section including a plate portion having one side in the form of a flat surface and a plurality of ridges projecting upright from the other side of the plate portion integrally therewith and spaced from one another. The first work roll has a plurality of ridge forming annular grooves formed in the peripheral surface thereof over the entire circumference of the surface and arranged at a spacing axially of the first work roll. The two work rolls are rotated so that the peripheral speed of the bottom face of the deepest of all the ridge forming annular grooves in the first work roll is not less than the peripheral speed of the peripheral surface of the second work roll.

23 Claims, 13 Drawing Sheets

U.S. PATENT DOCUMENTS

| | | | | |
|---|---|---|---|---|
| 6,604,457 | B2 * | 8/2003 | Klug | 101/32 |
| 6,654,996 | B1 * | 12/2003 | Harris | 29/426.4 |
| 6,739,167 | B2 * | 5/2004 | Kobayashi et al. | 72/197 |

FOREIGN PATENT DOCUMENTS

| | | | |
|---|---|---|---|
| EP | 0 845 646 | A1 | 6/1998 |
| EP | 1 114 681 | A1 | 7/2001 |

* cited by examiner

ROLLING APPARATUS AND METHOD OF MAKING PRODUCT OF MISCELLANEOUS CROSS SECTION WITH USE OF SAME

CROSS REFERENCE TO RELATED APPLICATIONS

This application is an application filed under 35 U.S.C. §111 (a) claiming the benefit pursuant to 35 U.S.C. §119(e) (1) of the filing date of Provisional Application No. 60/478,346 filed Jun. 16, 2003 pursuant to 35 U.S.C. §111(b).

TECHNICAL FIELD

The present invention relates to rolling apparatus and a method of making products of miscellaneous cross section with use of the same.

The term "aluminum" as used herein and in the appended claims includes aluminum alloys in addition to pure aluminum.

BACKGROUND ART

In recent years, widely used in motor vehicle air conditioners in place of conventional serpentine condensers are condensers which comprise, as shown in FIG. 16, a pair of headers 80, 81 arranged in parallel and spaced apart from each other, parallel flat refrigerant tubes 82 made of aluminum and each joined at its opposite ends to the two headers 80, 81, corrugated aluminum fins 83 each disposed in an air flow clearance between adjacent refrigerant tubes 82 and brazed to the adjacent tubes 82, an inlet pipe 84 connected to the upper end of peripheral wall of the first 80 of the headers, an outlet pipe 85 connected to the lower end of peripheral wall of the second 81 of the headers, a first partition 86 provided inside the first header 80 and positioned above the midportion thereof, and a second partition 87 provided inside the second header 81 and positioned below the midportion thereof, the number of refrigerant tubes 82 between the inlet pipe 84 and the first partition 86, the number of refrigerant tubes 82 between the first partition 86 and the second partition 87 and the number of refrigerant tubes 82 between the second partition 87 and the outlet pipe 85 decreasing from above downward to provide groups of channels. A refrigerant flowing into the inlet pipe 84 in a vapor phase flows zigzag through the units of channel groups in the condenser before flowing out via the outlet pipe 85 in a liquid phase. The condensers of the construction described are called multiflow condensers, and realize high efficiencies, lower pressure losses and supercompactness.

It is required that the refrigerant tube 82 of the condenser described be excellent in heat exchange efficiency and have pressure resistance against the high-pressure gaseous refrigerant to be introduced thereinto. Moreover, the tube needs to be small in wall thickness and low in height so as to make the condenser compact.

A flat tube outstanding in heat exchange efficiency and adapted for use as such a refrigerant tube 82 is already known which comprises an upper and a lower wall, a right and a left side wall interconnecting the upper and lower walls at the respective right and left side edges thereof, and a plurality of reinforcing walls interconnecting the upper and lower walls, extending longitudinally of the tube and spaced from one another as positioned between the right and left side walls, the tube having parallel fluid channels formed inside thereof, each of the reinforcing walls being formed from a downward ridge projecting downward from the upper wall integrally therewith and an upward ridge projecting upward from the lower wall integrally therewith by brazing the two ridges to each other as butted against each other (see the publication of Japanese Patent No. 2915660, FIG. 4).

Such a flat tube is fabricated from a single sheet of metal product of miscellaneous cross section having two flat wall forming portions connected to each other by a connecting portion, a side wall ridge projecting from each flat wall forming portion integrally therewith at a side edge thereof opposite to the connecting portion and reinforcing wall ridges projecting inward from each flat wall forming portion integrally therewith, by bending the product to the shape of a hairpin at the connecting portion to butt the side wall ridges, as well as each pair of corresponding reinforcing wall ridges, to each other, and brazing the butted ridges in corresponding pairs.

Another flat tube outstanding in heat exchange efficiency and adapted for use as such a refrigerant tube 82 is also known as disclosed in the above publication. This flat tube comprises an upper and a lower wall, a right and a left side wall interconnecting the upper and lower walls at the respective right and left side edges thereof, and a plurality of reinforcing walls interconnecting the upper and lower walls, extending longitudinally of the tube and spaced from one another as positioned between the right and left side walls, the tube having parallel fluid channels formed inside thereof, each of the reinforcing walls being formed from a reinforcing wall ridge projecting inward from at least one of the upper and lower walls integrally therewith, by brazing the ridge to the flat inner surface of the other wall.

Such a flat tube is fabricated from a single sheet of metal product of miscellaneous cross section having two flat wall forming portions connected to each other by a connecting portion, a sidewall ridge projecting from each flat wall forming portion integrally therewith at a side edge thereof opposite to the connecting portion and reinforcing wall ridges projecting from at least one of the flat wall forming portions integrally therewith in the same direction as the side wall ridge thereon, by bending the product to the shape of a hairpin at the connecting portion to butt the side wall ridges against each other and to bring the outer ends of the reinforcing wall ridges on the above-mentioned one flat wall forming portion into contact with the other flat wall forming portion, and brazing the side wall ridges to each other and the outer ends of the reinforcing wall ridges to the other flat wall forming portion.

As disclosed in the above publication, the product of miscellaneous cross section described is manufactured from a brazing sheet having a brazing material layer on opposite sides thereof by passing the sheet through a rolling apparatus comprising a first work roll provided with ridge forming annular grooves over the entire circumference thereof for forming the side wall ridges and the reinforcing wall ridges, and a second work roll having a smooth cylindrical peripheral surface.

In the case where rolled sheets are manufactured by the rolling apparatus having two work rolls, both the work rolls are generally made from a high-speed tool steel and have respective peripheral surfaces of the same diameter. When the above-mentioned product of miscellaneous cross section is to be manufactured by passing a brazing sheet through a rolling apparatus comprising a first work roll provided with ridge forming annular grooves over the entire circumference thereof for forming the side wall ridges and the reinforcing wall ridges, and a second work roll having a smooth cylindrical peripheral surface, the portions of peripheral surface of the first work roll where no ridge forming annular grooves are formed are conventionally given a diameter equal to the diameter of the peripheral surface of the second work roll.

However, this rolling apparatus has the problem that the bottom portions of the ridge forming annular grooves in the first work roll wear away at a rate higher than is estimated.

In order to inhibit the wear of work rolls having a smooth cylindrical peripheral surface, it has been proposed to form in the peripheral surface of the roll minute surface irregularities providing a reservoir for the rolling oil (see the publication of JP-A No. 1998-166010).

Means nevertheless has yet to be found for inhibiting the wear on the bottom portions of the ridge forming grooves, for use in the work roll having these grooves for making products of miscellaneous cross section such as the one described above.

An object of the present invention is to overcome the above problem and to provide a rolling apparatus comprising a work roll which has ridge forming annular grooves in its peripheral surface and which is inhibited from wearing away at the bottom portions of the grooves, and a method of manufacturing a product of miscellaneous cross section with use of the apparatus.

DISCLOSURE OF THE INVENTION

The present inventors have conducted extensive research on causes for the wear on the bottom faces of the ridge forming annular grooves of rolling apparatus and found that the peripheral speed of the bottom faces of the ridge forming annular grooves is considerably smaller than the speed of the material at the outlet side of the two work rolls of the rolling apparatus, and that a relatively great frictional force is exerted by the metal material on the bottom faces of the ridge forming annular grooves owing to the difference between the two speeds, consequently permitting the annular groove bottom faces to wear away progressively. The present invention has been accomplished based on these findings. The present invention comprises the following modes.

1) A rolling apparatus comprising a first work roll and a second work roll cooperative with the first work roll for rolling a metal blank plate to manufacture a metal product of miscellaneous cross section comprising a plate portion and a plurality of ridges projecting upright from one side of the plate portion integrally therewith and spaced from one another, the first work roll having a plurality of ridge forming annular grooves formed in a peripheral surface thereof over the entire circumference of the surface and arranged at a spacing axially of the first work roll, the two work rolls being rotatable so that the peripheral speed of a bottom face of the deepest of all the ridge forming annular grooves in the first work roll is not smaller than the peripheral speed of a peripheral surface of the second work roll.

2) A rolling apparatus as described in the above para. 1) wherein the second work roll is provided singly for the first work roll, the bottom face of the deepest of all the ridge forming annular grooves in the first work roll having a diameter not smaller than the diameter of the peripheral surface of the second work roll, and the two work rolls are rotated at the same number of revolutions.

3) A rolling apparatus as described in the above para. 1) wherein a plurality of second work rolls are arranged around the first work roll circumferentially thereof at a spacing, the peripheral surfaces of the second work rolls having a diameter different from the diameter of the bottom face of the deepest of all the ridge forming annular grooves in the first work roll, and the work rolls are so rotated that the first work roll is different from the second work rolls in the number of revolutions.

4) A rolling apparatus as described in the above para. 1) wherein the bottom face of the deepest ridge forming annular groove in the entire first work roll has a surface layer made of a cemented carbide.

5) A rolling apparatus as described in the above para. 1) wherein the first work roll has a plurality of ridge forming annular grooves formed in the peripheral surface thereof.

6) A rolling apparatus as described in the above para. 5) wherein the first work roll comprises a roll body, and a flange fixed to each of opposite ends of the roll body and having a larger diameter than the roll body, the roll body being made of a cemented carbide, the plurality of ridge forming annular grooves being formed in a peripheral surface of the roll body.

7) A rolling apparatus as described in the above para. 5) wherein the first work roll is made of a cemented carbide in its entirety.

8) A rolling apparatus as described in the above para. 1) wherein the first work roll comprises a plurality of disks stacked on a straight line and having different diameters, and a pair of flanges arranged at opposite ends of the stack of disks and fixedly holding the disks together, each of the disks having an outer peripheral surface serving as a working surface, the disks including large-diameter disks positioned at portions where no ridges are to be formed and small-diameter disks arranged at portions where the respective ridges are to be formed and smaller in diameter than the large-diameter disks by an amount corresponding to the height of the ridges, the ridge forming annular grooves being provided at the respective portions where the small-diameter disks are arranged.

9) A rolling apparatus as described in the above para. 8) wherein the small-diameter disks are made of a cemented carbide.

10) A rolling apparatus as described in the above para. 1) wherein the ridge forming annular grooves are an even number of at least 2 in number, and all the ridge forming annular grooves as arranged axially of the first work roll are symmetric about a center of the first work roll with respect to the axial direction thereof.

11) A rolling apparatus as described in the above para. 10) wherein all the ridge forming annular grooves are equal in depth.

12) A rolling apparatus as described in the above para. 10) wherein a pair of ridge forming annular grooves symmetric to each other are equal to each other in width.

13) A rolling apparatus as described in the above para. 12) wherein the ridge forming annular grooves are an even number of at least 4 in number, and all the ridge forming annular grooves other than the two ridge forming annular grooves positioned respectively at opposite ends are equal in width, the two ridge forming annular grooves positioned at opposite ends having a larger width than the other ridge forming annular grooves.

14) A rolling apparatus as described in the above para. 10) wherein the peripheral surface of the first work roll has an annular groove formed at the axial center the first work roll over the entire circumference thereof and having a larger width and a smaller depth than the ridge forming annular grooves.

15) A rolling apparatus as described in the above para. 1) wherein the ridge forming annular grooves are at least 3 in number, and the two ridge forming annular grooves as arranged at axial opposite ends of the first work roll are symmetric about a center of the first work roll with respect to the axial direction thereof, the other ridge forming annular groove or grooves being provided between said two ridge forming annular grooves.

16) A rolling apparatus as described in the above para. 15) wherein the ridge forming annular grooves are at least 4 in number, and the ridge forming annular grooves other than the two ridge forming annular grooves positioned respectively at opposite ends are asymmetric about the center of the first work roll with respect to the axial direction thereof.

17) A rolling apparatus as described in the above para. 15) wherein the two ridge forming annular grooves positioned respectively at opposite ends are equal to each other in depth, and the other ridge forming annular grooves are equal in depth, the two ridge forming annular grooves at respective opposite ends having a smaller depth than the other ridge forming annular grooves.

18) A rolling apparatus as described in the above para. 15) wherein the two ridge forming annular grooves positioned respectively at opposite ends are equal to each other in width.

19) A rolling apparatus as described in the above para. 18) wherein all the ridge forming annular grooves other than the two ridge forming annular grooves positioned respectively at opposite ends are equal in width, and the two ridge forming annular grooves positioned at opposite ends have a larger width than the other ridge forming annular grooves.

20) A rolling apparatus as described in the above para. 15) wherein the peripheral surface of the first work roll has an annular groove formed at the axial center the first work roll over the entire circumference thereof and having a larger width and a smaller depth than the ridge forming annular grooves.

21) A rolling apparatus as described in the above para. 10) or 15) wherein one of the two ridge forming annular grooves positioned respectively at opposite ends is provided in a bottom face thereof with an annular furrow over the entire circumference for forming a projection, and the other of the two ridge forming annular grooves at the ends is provided on a bottom face thereof with an annular projection over the entire circumference for forming a groove for the projection to be formed by the annular furrow to fit in.

22) A rolling apparatus as described in the above para. 1) wherein all the ridge forming annular grooves are equal in depth.

23) A rolling apparatus as described in the above para. 22) wherein the ridge forming annular grooves are at least 3 in number, and the two ridge forming annular grooves positioned respectively at opposite ends are equal to each other in width.

24) A method of manufacturing a product of miscellaneous cross section characterized by passing a metal blank plate between the first and second work rolls of a rolling apparatus as described in any one of the above para. 1) to 23).

25) A method of manufacturing a product of miscellaneous cross section as described in the above para. 24) wherein the metal blank plate comprises an aluminum brazing sheet having a brazing material layer on at least one side thereof to be provided with the ridges.

With the rolling apparatus described in the above para. 1) to 3), the two work rolls are so rotated that the peripheral speed of the bottom face of the deepest of all the ridge forming annular grooves in the first work roll is not smaller than that of the peripheral surface of the second work roll, with the result that the difference between the speed of the metal material at the outlet side and the peripheral speed of the bottom face is smaller than in the prior art. This diminishes the wear on the bottom face due to the friction between the metal material and the bottom face.

With the rolling apparatus described in the above para. 4) to 9), the bottom faces of the ridge forming annular grooves have a surface layer which is made of a cemented carbide, so that the bottom faces are inhibited from wearing away more effectively.

The rolling apparatus described in the above para. 10) to 23) are adapted to manufacture products of miscellaneous cross sections while the bottom face of the deepest ridge forming annular groove in the first work roll is being inhibited from wearing away.

The method described in the above para. 24) is adapted to manufacture products of miscellaneous cross sections while the bottom face of the deepest ridge forming annular groove in the first work roll is being inhibited from wearing away.

With the method described in the above para. 25) of manufacturing a product of miscellaneous cross section, the metal blank plate comprises an aluminum brazing sheet having a brazing material layer on at least one side thereof to be provided with the ridges. The method therefore has the following advantage. Since the brazing material layer is made from an Al—Si alloy which is harder than common aluminum, the bottom faces of the ridge forming annular grooves wear away markedly in this case. However, when the rolling apparatus described in the para. 1) to 23) are used for manufacturing products of miscellaneous cross sections, the wear on the bottom faces of the ridge forming annular grooves can be inhibited even if the metal blank plate used is an aluminum brazing sheet having a brazing material layer on the side thereof to be provided with the ridges.

BEST MODE OF CARRYING OUT THE INVENTION

Figure 1:
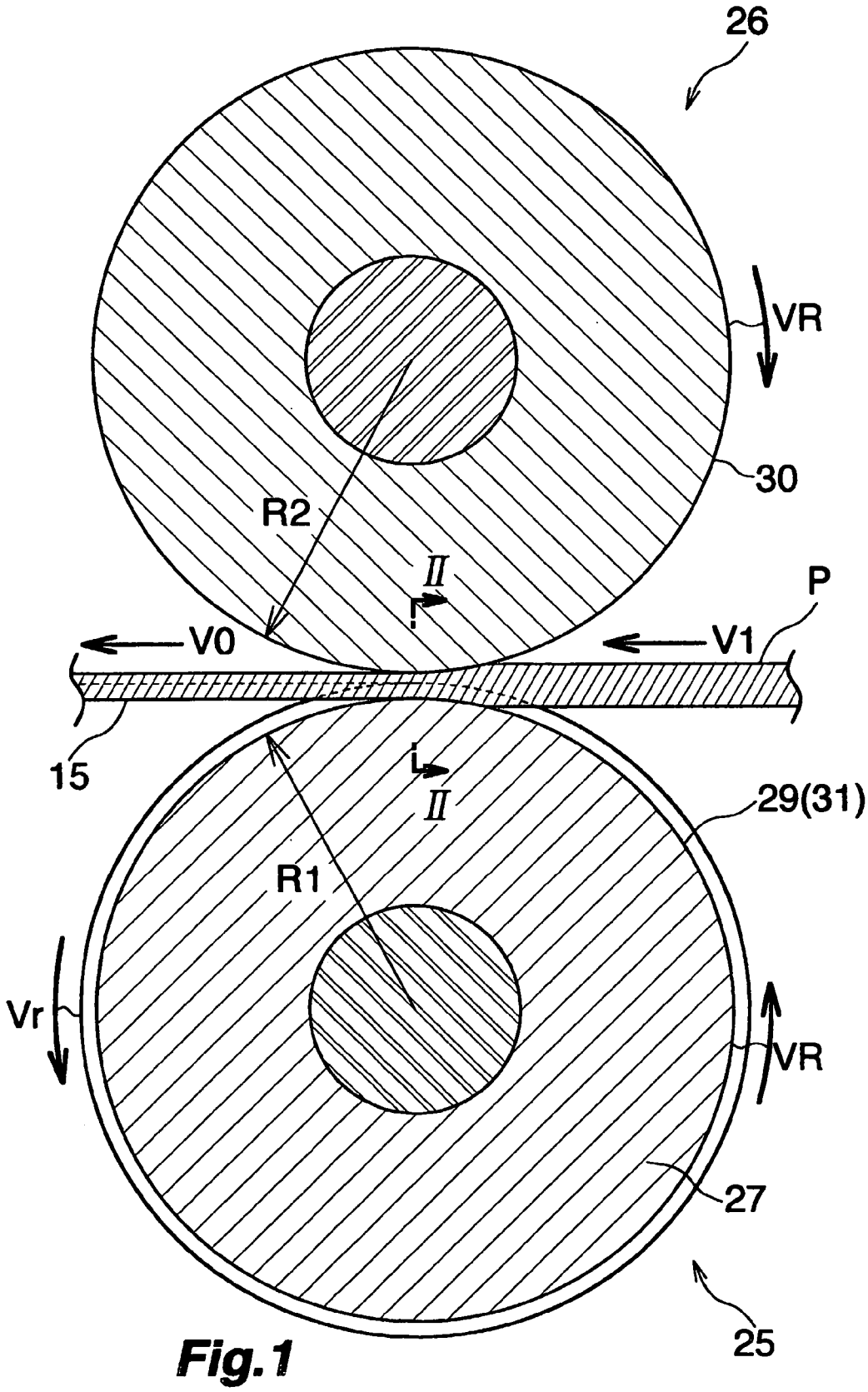
FIG. 1 is a view in vertical section showing a rolling apparatus of Embodiment 1 of the present invention.

Embodiments of the present invention will be described below in detail with reference to the drawings. In the following description, the upper and lower sides and the left- and right-hand sides of FIGS. 2 to 14 will be referred to as "upper," "lower," "left" and "right," respectively. Further throughout the drawings, like parts will be designated by like reference numerals and will not be described repeatedly.

Embodiment 1

This embodiment is shown in FIGS. 1 to 5.

Figure 2:
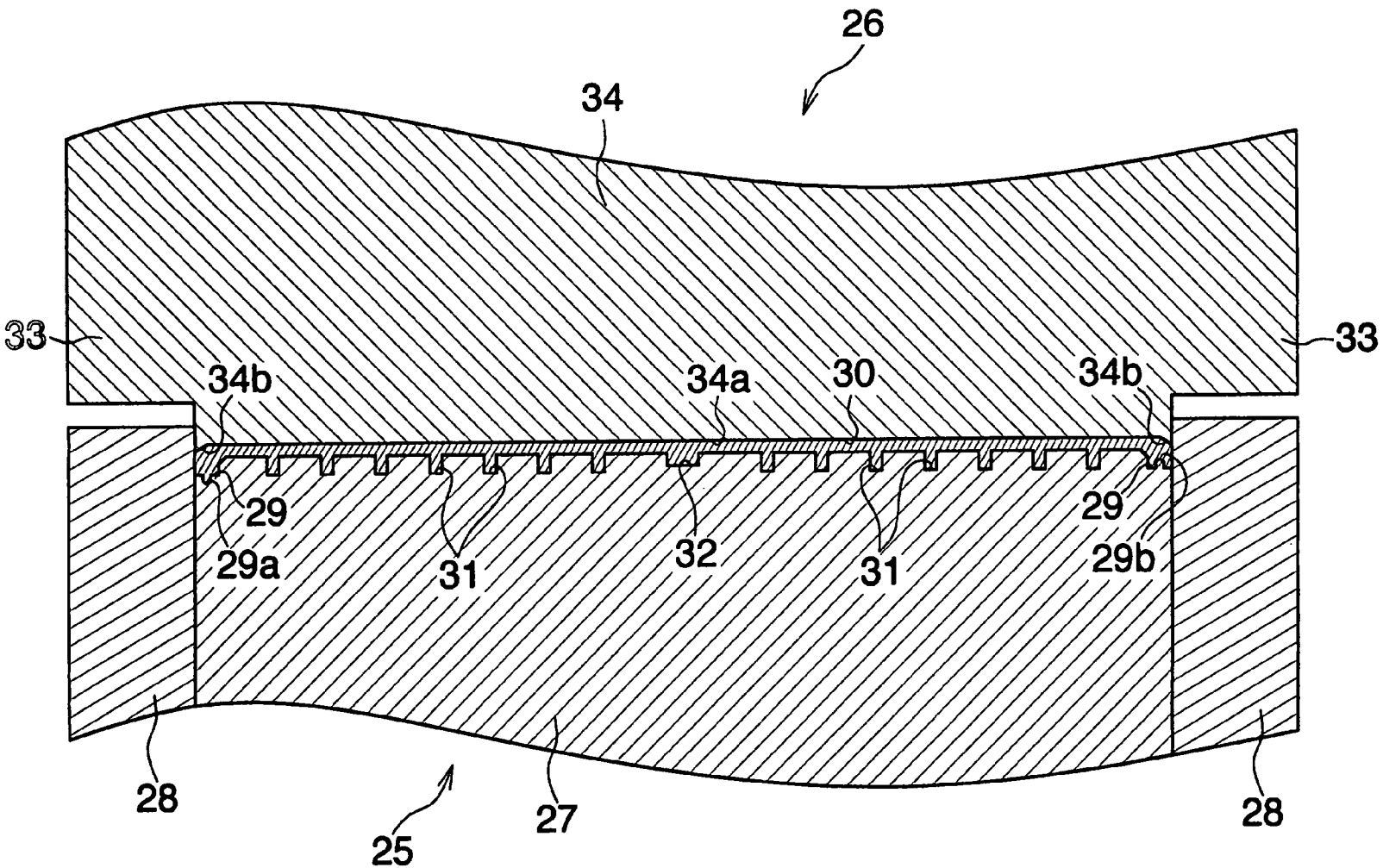
FIG. 2 is a view in section taken along the line II-II in FIG. 1.
Figure 3:
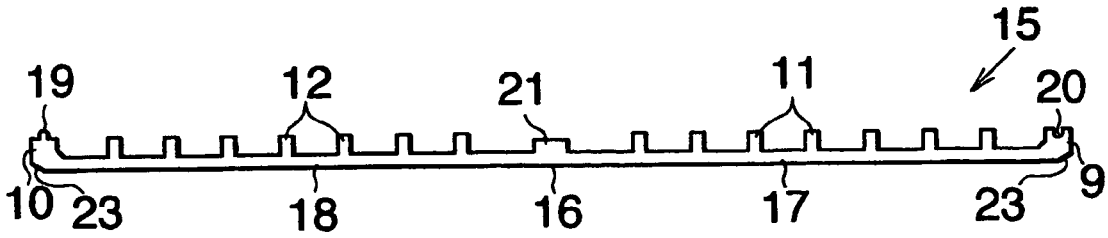
FIG. 3 is a front view of a product of miscellaneous cross section manufactured by the rolling apparatus of FIG. 1.
Figure 4:
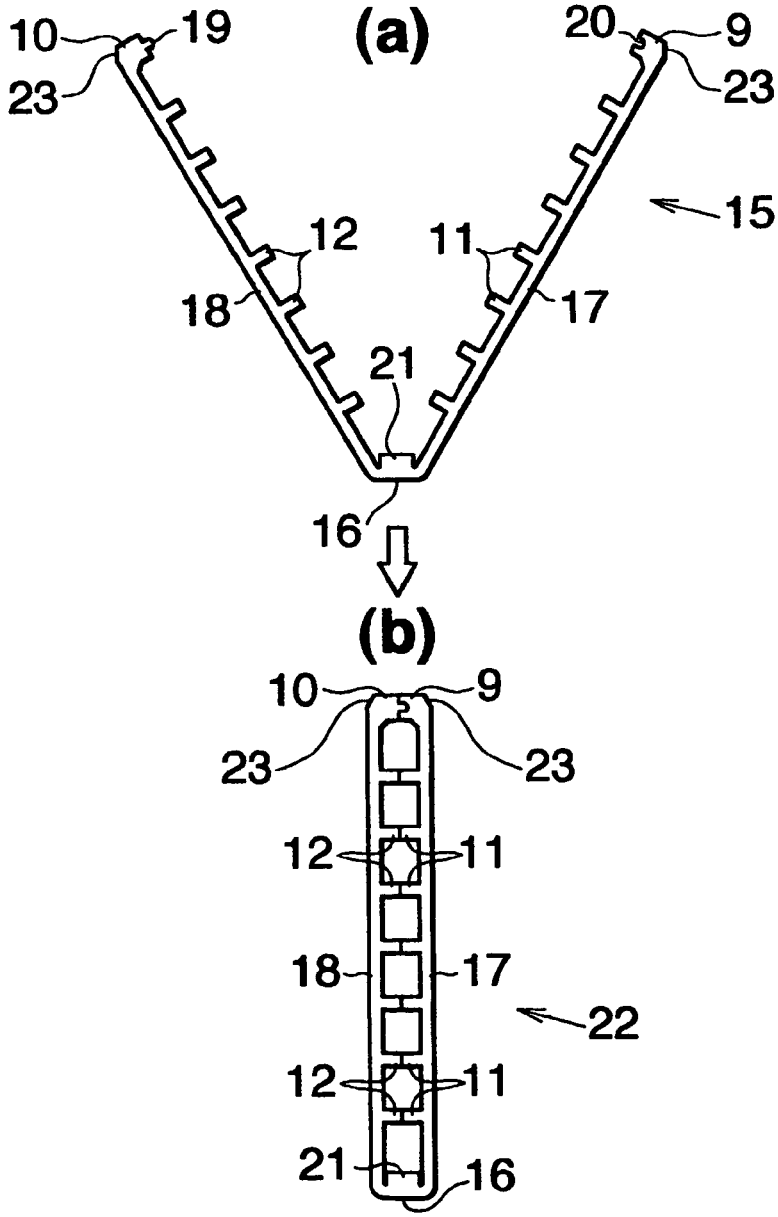
FIG. 4 is a front view showing a method of manufacturing a flat tube using the product of miscellaneous cross section shown in FIG. 3.
Figure 5:
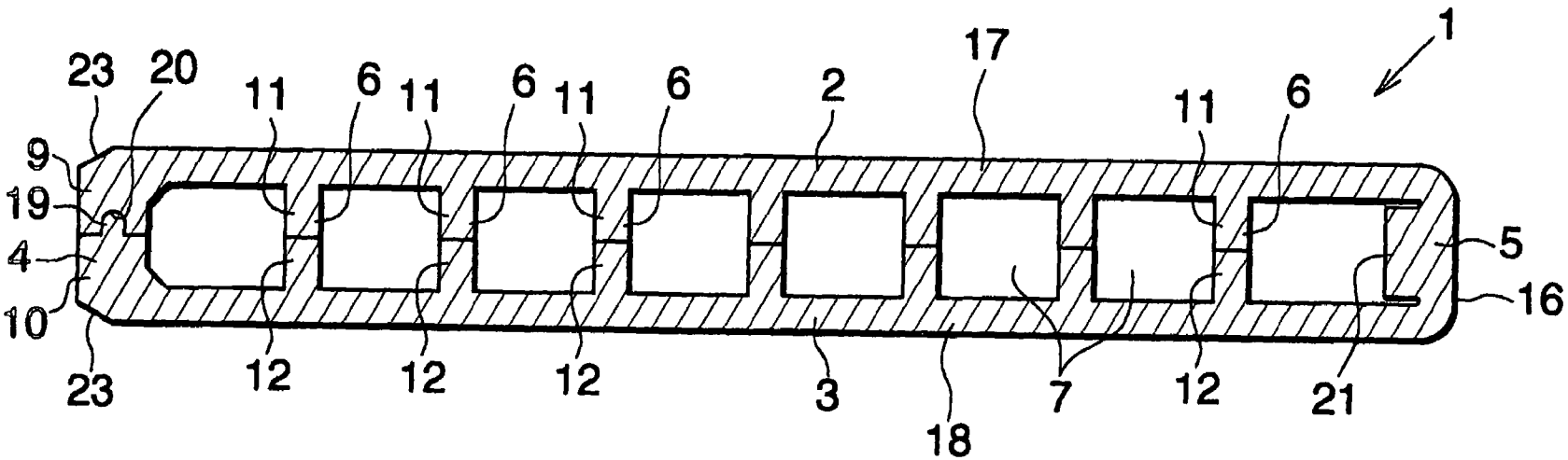
FIG. 5 is a view in cross section showing the flat tube manufactured by the method of FIG. 4.

FIGS. 1 and 2 show a rolling apparatus of Embodiment 1, and FIG. 3 shows a product of miscellaneous cross section to be manufactured by the apparatus, i.e., a metal plate for making flat tubes. FIG. 4 shows a method of fabricating the flat tube from the metal plate, and FIG. 5 shows the flat tube.

First with reference to FIG. 5, the flat tube will be described which is fabricated from the product of miscellaneous cross section to be manufactured by the rolling apparatus of Embodiment 1.

The flat tube 1 comprises flat upper and lower walls (a pair of flat walls) 2, 3 opposed to each other, left and right two side walls 4, 5 interconnecting the upper and lower walls 2, 3 at the respective left and right side edges thereof, and a plurality of reinforcing walls 6 interconnecting the upper and lower walls 2, 3, extending longitudinally of the tube and spaced from one another as positioned between the left and right side walls 4, 5. The tube 1 has parallel fluid channels 7 formed inside thereof. Although not shown, each reinforcing wall 6 has a plurality of communication holes for holding adjacent fluid channels 7 in communication with each other. When seen from above, all the communication holes are in a staggered arrangement.

The left side wall 4 is made from a side wall ridge 9 projecting downward from the left side edge of the upper wall 2 integrally therewith and a side wall ridge 10 projecting upward from the left side edge of the lower wall 3 integrally therewith, by brazing the side wall ridges 9, 10 as butted against each other. The right side wall 5 is made integral with the upper and lower walls 2, 3.

Each reinforcing wall 6 is made from a reinforcing wall ridge 11 projecting downward from the upper wall 2 integrally therewith and a reinforcing wall ridge 12 projecting upward from the lower wall 3 integrally therewith by brazing the ridges 11, 12 as butted against each other.

The flat tube 1 is fabricated from a metal plate 15 which is a product of miscellaneous cross section as shown in FIG. 3. The metal plate 15 for making the flat tube is made from an aluminum brazing sheet having a brazing material layer on opposite sides thereof, and comprises flat upper wall forming portion (flat wall forming portion) 17 and lower wall forming portion (flat wall forming portion) 18, a connecting portion 16 interconnecting the upper wall forming portion 17 and the lower wall forming portion 18 for providing the right side wall 5, side wall ridges 9, 10 projecting upward respectively from the upper wall forming portion 17 and the lower wall forming portion 18 integrally therewith each at the side edge thereof opposite to the connecting portion 16 for making the left side wall 4, and a plurality of reinforcing wall ridges 11, 12 projecting upward from the upper wall forming portion 17 and the lower wall forming portion 18, respectively, integrally therewith and arranged laterally at a predetermined spacing. The reinforcing wall ridges 11 on the upper wall forming portion 17 are positioned symmetrically to those 12 on the lower wall forming portion 18 about the center line of the metal plate 15 with respect to the widthwise direction thereof. The side ridges 9, 10 and all the reinforcing wall ridges 11, 12 are equal in height. The side wall ridges 9, 10 are equal to each other in thickness, and all the reinforcing wall ridges 11, 12 are also equal in thickness. The side wall ridges 9, 10 are larger than the reinforcing wall ridges 11, 12 in thickness. A bending position determining ridge 21 is integrally formed on a major part of the connecting portion 16 other than left and right side edges thereof over the entire length of the metal plate. The position determining ridge 21 is smaller than the side wall ridges 9, 10 and the reinforcing wall ridges 11, 12 in height, and larger than the ridges 9, 10, 11, 12 in width. The lower surface of each of the upper and lower wall forming portions 17, 18 has a slope 23 formed at the side edge thereof opposite to the connecting portion 16 and slanting laterally outwardly upward. The lower surfaces of the upper and lower wall forming portions 17, 18 and the connecting portion 16 other than the slopes 23 are flat and positioned in the same horizontal plane.

The side wall ridges 9, 10 and the reinforcing wall ridges 11, 12 are formed on one side of an aluminum brazing sheet integrally therewith, the sheet having a cladding of brazing material on each of opposite sides thereof. This forms a brazing material layer (not shown) on opposite sides and end faces of the side wall ridges 9, 10 and the reinforcing wall ridges 11, 12, and on the upper and lower surfaces of the upper and lower wall forming portions 17, 18. The brazing material layer on the end faces of the ridges 9, 10, 11, 12 has a larger thickness than the brazing material layer on the other portions. The side wall ridge 10 on the lower wall forming portion 18 has a projection 19 formed on the outer end thereof integrally therewith and extending longitudinally of the ridge. On the other hand, the side wall ridge 9 on the upper wall forming portion 17 has a groove 20 formed in the outer end thereof and extending longitudinally of the ridge for the projection 19 to be forced in. The brazing material layer exits on the outer end face and opposite side faces of the projection 19, and on the inside bottom face and opposite side faces of the ridge 9 defining the groove 20.

The flat tube 1 is fabricated by progressively bending the metal plate 15 at the left and right opposite side edges of the connecting portion 16 [see FIG. 4(*a*)], finally bending the plate 15 to the shape of a hairpin to butt the side wall ridges 9, 10, as well as each corresponding pair of reinforcing wall ridges 11, 12, against each other, force the projection 19 into the groove 20 and obtain a folded body 22 [see FIG. 4(*b*)] by the roll forming process, and brazing the side wall ridges 9, 10, as well as each corresponding pair of reinforcing wall ridges 11, 12, to each other. At this time, the left side wall 4 is formed by the side wall ridges 9, 10 brazed to each other, the right side wall 5 by the connecting portion 16, the upper wall 2 by the upper wall forming portion 17, the lower wall 3 by the lower wall forming portion 18, and the reinforcing walls 6 by the respective corresponding pairs of reinforcing wall ridges 11, 12.

Figure 16:
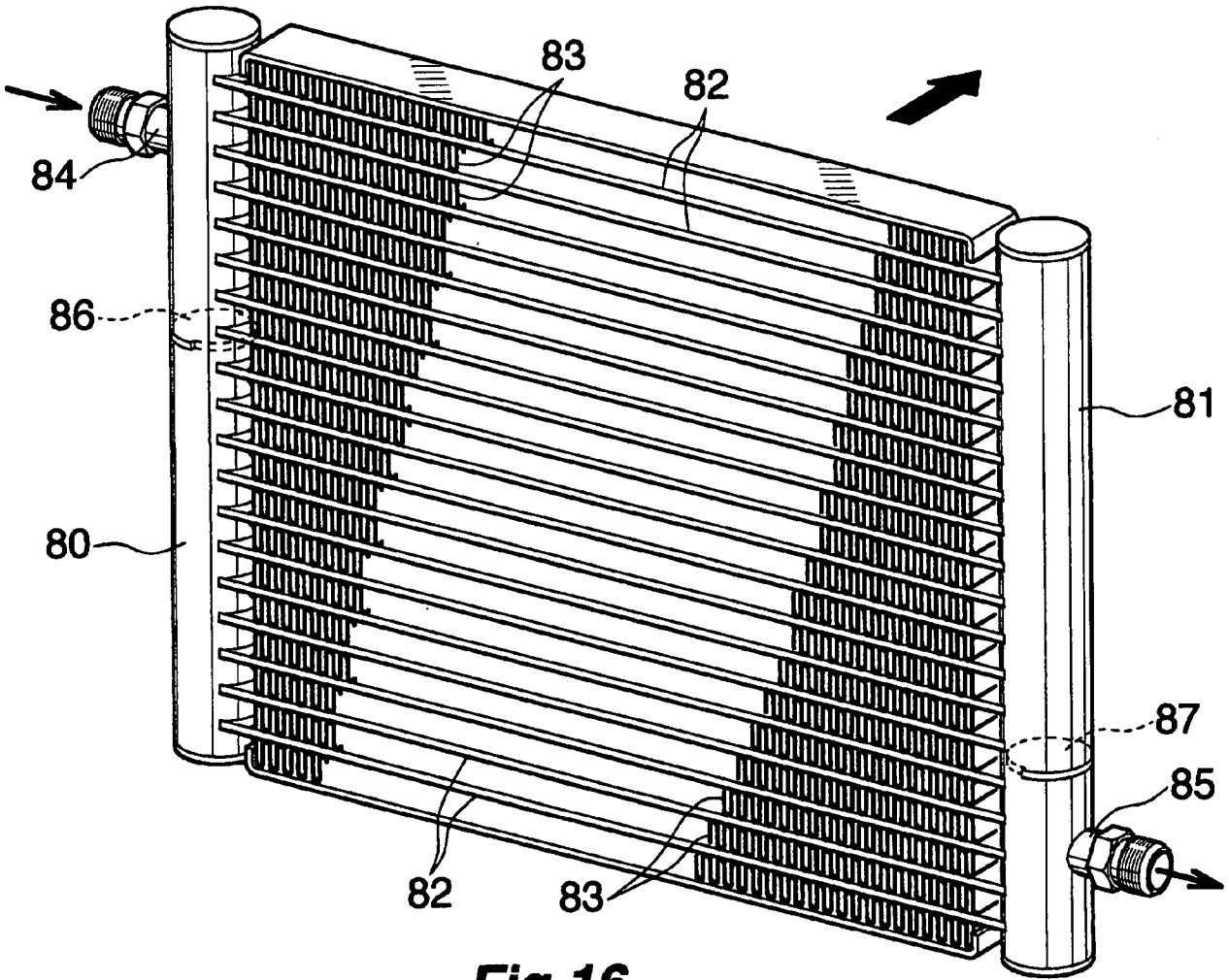
FIG. 16 is a perspective view showing a condenser for use in a motor vehicle air conditioner.

In the case where the flat tube 1 is used, for example, as the refrigerant tube 82 of a condenser shown in FIG. 16, such flat tubes 1 may be made simultaneously with the fabrication of the condenser. Stated more specifically, the condenser is fabricated in the following manner. Prepared first are a plurality of folded bodies 22, a pair of aluminum headers 80, 81 each having insertion holes which are equal in number to the number of the folded bodies 22, and a plurality of corrugated aluminum fins 83. Subsequently, the pair of headers 80, 81 are arranged as spaced apart, the plurality of folded bodies 22 and the fins 83 are arranged alternately, and opposite ends of the folded bodies 22 are placed into the corresponding insertion holes of the headers 80, 81. The resulting arrangement is thereafter heated at a predetermined temperature to braze the side wall ridges 9, 10, as well as each corresponding pair of reinforcing wall ridges 11, 12, of each folded body 22 to each other, and braze the folded bodies 22 to the headers 80, 81 and the corrugated fins 83 to respective adjacent pairs of folded bodies 22 at the same time using the brazing material layers of the metal plate 15. In this way, the condenser is fabricated. Along with a compressor and an evaporator, this condenser 1 provides a refrigeration cycle and is installed, for example, in a motor vehicle for use as a motor vehicle air conditioner.

Next with reference to FIGS. 1 and 2, a description will be given of the rolling apparatus for manufacturing the metal plate 15 for making the flat tube. The rolling apparatus comprises a first work roll 25, and a second work roll 26 cooperative with the roll 25 for rolling a metal blank plate P.

The first work roll 25 comprises a roll body 27, and a flange 28 having a larger diameter than the roll body 27 and fixed to each of opposite ends of the roll body 27. The roll body 27 is made from a cemented carbide such as JIS V10, JIS V20, JIS V30, JIS V40, JIS V50 or JIS V60.

Two first annular grooves 29 for forming the respective side wall ridges 9, 10 are formed in the peripheral surface of the roll body 27 respectively at axial opposite ends thereof. The peripheral surface of the roll body 27 has an even number of second annular grooves 31 formed in the portion thereof between the two first annular grooves 29 and arranged at a spacing axially of the roll body 27 for making the reinforcing wall ridges 11, 12. All the annular grooves 29, 31 are in symmetry (bilateral symmetry) about the center of the roll body 27, i.e., of the first work roll 25, with respect to the axial direction thereof. All the annular grooves 29, 31 are equal in depth. The two first annular grooves 29 are equal to each other in width, all the second annular grooves 31 are also equal in width, and the first annular grooves 29 are larger than the second annular grooves 31 in width. The bottom face of one of the first annular grooves 29 has an annular furrow 29*a* over the entire circumference for forming the projection 19. The bottom face of the other first annular groove 29 is integrally provided with an annular projection 29*b* over the entire circumference for forming the groove 20 for fitting therein the projection 19 formed by the annular furrow 29*a*. A third annular groove 32 having a larger width and a smaller depth than all the annular grooves 29, 31 for forming the bending position determining ridge 21 is formed in the peripheral surface of the roll body 27, i.e., of the first work roll 25, at the center thereof with respect to the axial direction over the entire circumference.

The second work roll 26 is integrally formed from a die steel, high-speed tool steel, cemented carbide or the like and has a small-diameter portion 33 at each of opposite ends thereof. Useful cemented carbides are, for example, those already mentioned for use in making the roll body 27 of the first work roll 25. A large-diameter portion 34 of the second work roll 26 other than the small-diameter portions 33 is fitted to the roll body 27 between the flanges 28 of the first work roll 25 and has a peripheral surface serving as a working surface 34*a*. The working surface 34*a* of the second work roll 26 is provided at each of opposite ends thereof with a slope forming portion 34*b* so slanting as to gradually increase in diameter axially outward. The portion of the working surface 34*a* of the second work roll 26 other than the slope forming portions 34*b* is in the form of a cylindrical surface 30.

The cylindrical surface 30 of working surface 34*a* of the second work roll 26 has a radius R2 which is equal to the radius R1 of the bottom faces of the first annular grooves 29 and the second annular grooves 31 in the first work roll 25, and the two work rolls 25, 26 are rotated at the same number of revolutions. Accordingly, the peripheral speed of the bottom faces of the first and second annular grooves 29, 31 in the first work roll 25 is equal to the peripheral speed of the cylindrical surface 30 of working surface 34*a* of the second work roll 26. Incidentally, the peripheral speed of the bottom faces of the first and second annular grooves 29, 31 in the first work roll 25 may be made not smaller than the peripheral speed of the cylindrical surface 30 of working surface 34*a* of the second work roll 26 by making the radius R1 of the bottom faces of the first and second annular grooves 29, 31 in the first work roll 25 not smaller than the radius R2 of the cylindrical surface 30 of working surface 34*a* of the second work roll 26, and rotating the two work rolls 25, 26 at the same number of revolutions.

The metal plate 15 for making the flat tube is manufactured by passing a metal blank plate P in the form of an aluminum brazing sheet having a brazing material layer on opposite sides thereof between the first work roll 25 and the second work roll 26 of the rolling apparatus to transfer to the metal sheet P the first annular grooves 29, annular furrow 29*a*, annular projection 29*b*, second annular grooves 31 and third annular groove 32 formed in the first work roll 25 and the slope forming portions 34*b* formed on the second work roll 26.

Now suppose the speed of the material at the inlet side where the metal blank plate P is fed to the apparatus is V1, the speed of the material at the outlet side where the metal blank plate P is sent out from the apparatus is V0, the peripheral speed of the bottom faces of the first and second annular grooves 29, 31 in the first work roll 25 (=the peripheral speed of the cylindrical surface 30 of working surface 34*a* of the second work roll 26) is VR, and the peripheral speed of the peripheral surface of the first work roll 25 at the portions thereof where the annular grooves 29, 31 are not formed is Vr. Then V0>VR>Vr>V1. Accordingly, the difference between the speed V0 of the material at the outlet side and the peripheral speed VR of the bottom faces of the first and second annular grooves 29, 31 in the first work roll 25, i.e., V0−VR, is smaller than the difference between the speed V0 of the material at the outlet side and the peripheral speed Vr of the peripheral surface of the first work roll 25 at the portions thereof where the annular grooves 29, 31 are not formed, i.e., V0−Vr, with the result that the frictional force exerted by the metal material on the bottom faces of the annular grooves 29, 31 is smaller than in the conventional rolling apparatus wherein the Vr is made equal to the peripheral speed of the working surface 34*a* of the second work roll 26 to inhibit the wear on the bottom faces of the annular grooves 29, 31.

The peripheral speed Vr of the peripheral surface of the first work roll 25 at the portions thereof where the annular grooves 29, 31 are not formed is greater than in the conventional apparatus wherein the Vr is made equal to the peripheral speed of the working surface 34*a* of the second work roll 26, but is unlikely to be greater than the speed V0 of the material at the outlet side, so that the difference between the speed V0 of the material at the outlet side and the peripheral speed Vr, i.e., V0−Vr, is smaller than in the conventional apparatus. Wear can therefore be inhibited more effectively on the portions of the first work roll 25 where the annular grooves 29, 31 are not formed.

Embodiment 2

Figure 6:
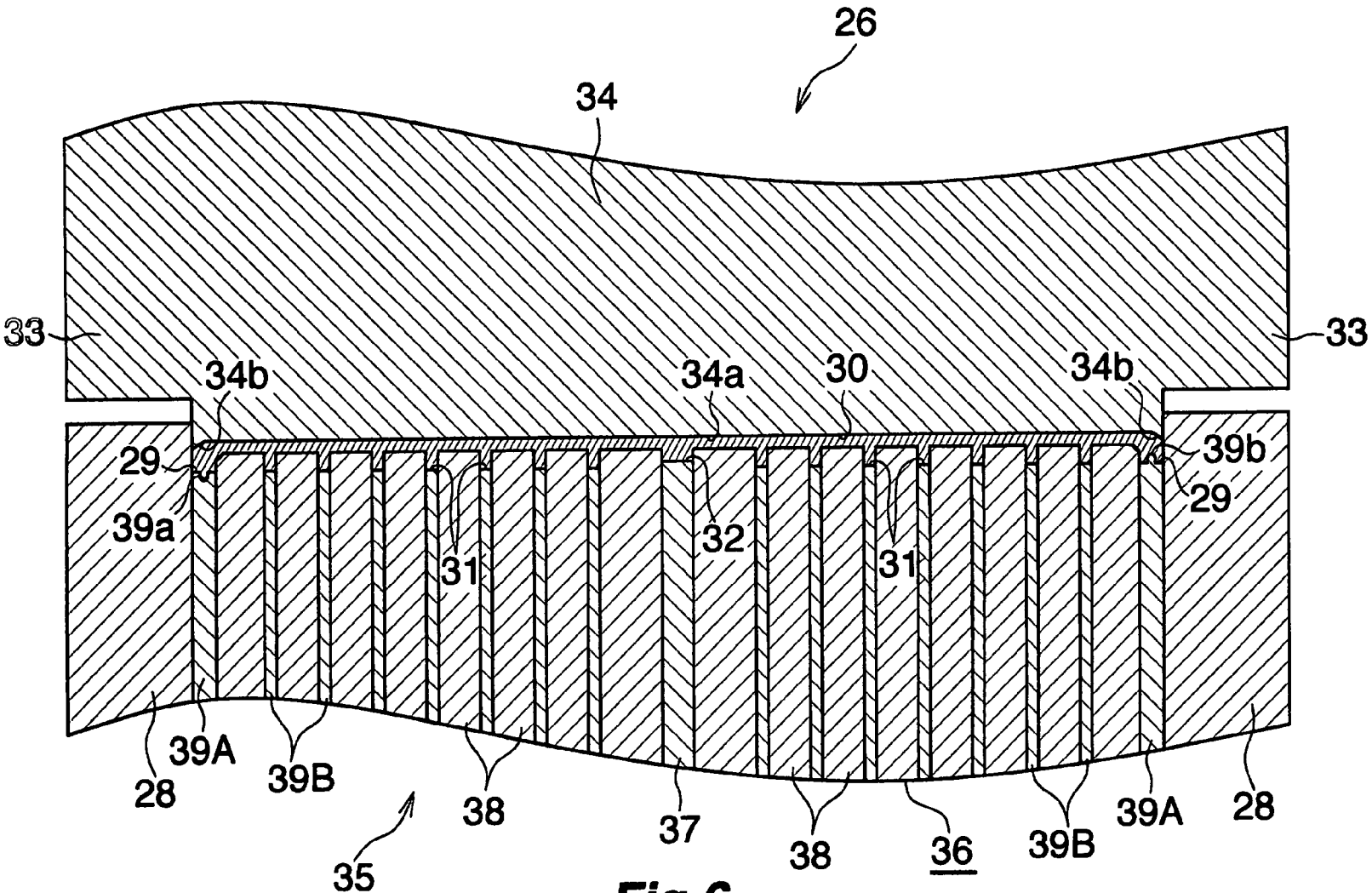
FIG. 6 is a view corresponding to FIG. 2 and showing a rolling apparatus of Embodiment 2 of the invention.

This embodiment is shown in FIG. 6 and is a rolling apparatus for manufacturing a metal plate 15 of the same shape as is manufactured by Embodiment 1 for making the flat tube.

With reference to FIG. 6, a first work roll 35 of the rolling apparatus has a roll body 36 comprising three kinds of disks 37, 38, 39A, 39B which are different in diameter and stacked on the same straight line. These disks 37, 38, 39A, 39B are fixedly held together between a pair of left and right flanges 28 at opposite sides of the stack. The disk 37 having a medium diameter is positioned at the center of the first work roll 35 with respect to the axial direction thereof. On each side of the disk 37, large-diameter disks 38 and small-diameter disks 39B are arranged alternately. Two small-diameter disks 39A are arranged at respective opposite ends of the roll 35. The large-diameter disks 38 are arranged at the respective portions of the roll which form none of the ridges 9 to 12 of the metal plate 15. The medium-diameter disk 37 and the large-diameter disks 38 are each made from a die steel, high-speed tool steel, cemented carbide or the like, and each have a peripheral surface serving as a working surface. Examples of useful cemented carbides are JIS V10, JIS V20, JIS V30, JIS V40, JIS V50, JIS V60 and the like. The small-diameter disks 39A, 39B are made from a cemented carbide such as JIS V10, JIS V20, JIS V30, JIS V40, JIS V50 or JIS V60 and each have a peripheral surface serving as a working surface. All the large-diameter disks 38 are equal in radius. The medium-diameter disk 37 is smaller than the large-diameter disks 38 in radius. All the small-diameter disks 39A, 39B have the same radius, which is equal to the radius R2 of the peripheral surface 30 of working surface 34*a* of a second work roll 26 and smaller than the radius of the medium-diameter disk 37. The two small-diameter disks 39A at opposite ends are equal to each other in thickness, and all the other small-diameter disks 39B are also equal in thickness. The small-diameter disks 39A at opposite ends are greater than the other small-diameter disks 39B in thickness. All the small-diameter disks 39A, 39B are smaller than the medium-diameter disk 37 in thickness. Formed in the periphery of the small-diameter disk 39A at one end over the entire circumference thereof is an annular furrow 39*a* for making the projection 19. Similarly formed on the periphery of the small-diameter disk 39A at the other end over the entire circumference thereof is an annular projection 39*b* for making the groove 20 for the projection 19 to be formed by the furrow 39*a* to fit in.

The third annular groove 32 is formed by the medium-diameter disk 37 and the two large-diameter disks 38 on opposite sides thereof. The first annular groove 29 is formed by the small-diameter disk 29A at each end and the large-diameter disk 38 and the flange 28 on opposite sides of the disk 29A. The second annular grooves 31 are formed by the other remaining small-diameter disks 29B and the two large-diameter disk 38 on opposite sides of each disk 29B.

The first and second work rolls 35, 26 are adapted to be rotated at the same number of revolutions. Since all the small-diameter disks 39A, 39B have a radius equal to the radius R2 of the cylindrical surface 30 of working surface 34*a* of the second work roll 26, the peripheral speed of the bottom faces of first and second annular grooves 29, 31 of the first work roll 35 is consequently equal to the peripheral speed of the cylindrical surface 30 of working surface 34*a* of the second work roll 26. Incidentally, the peripheral speed of the bottom faces of the first and second annular grooves 29, 31 in the first work roll 35 may be made not smaller than the peripheral speed of the cylindrical surface 30 of working surface 34*a* of the second work roll 26 by making the radius of the bottom faces of all the small-diameter disks 39A, 39B of the first work roll 35 not smaller than the radius R2 of the cylindrical surface 30 of working surface 34*a* of the second work roll 26, and rotating the two work rolls 35, 26 at the same number of revolutions.

The metal plate 15 for making the flat tube is manufactured using the rolling apparatus in the same manner as Embodiment 1. The bottom faces of the first and second annular grooves 29, 31 are inhibited from wearing away as is the case with Embodiment 1.

Embodiment 3

This embodiment is shown in FIGS. 7 to 10.

Figure 7:
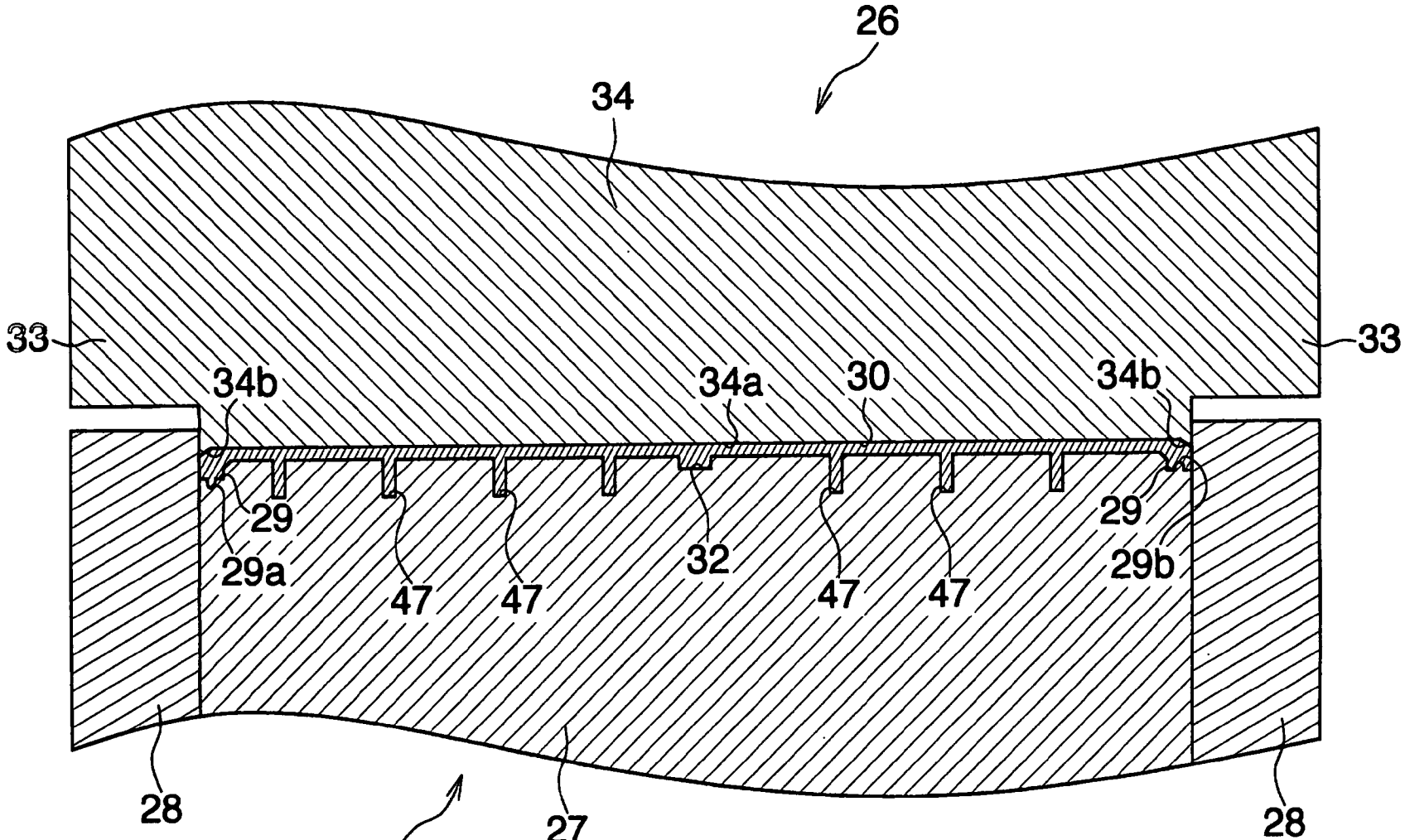
FIG. 7 is a view corresponding to FIG. 2 and showing a rolling apparatus of Embodiment 3 of the invention.
Figure 8:
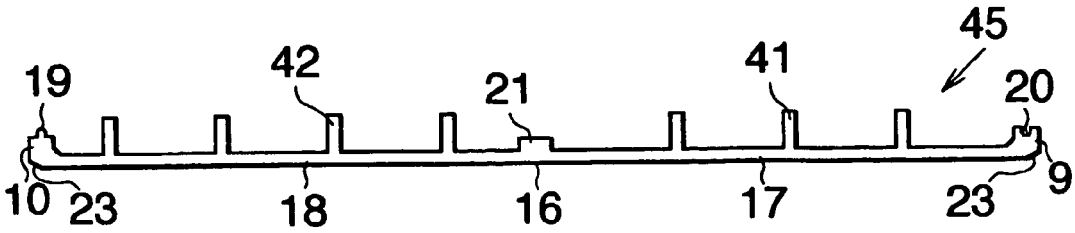
FIG. 8 is a front view of a product of miscellaneous cross section manufactured by the rolling apparatus of FIG. 7.
Figure 9:
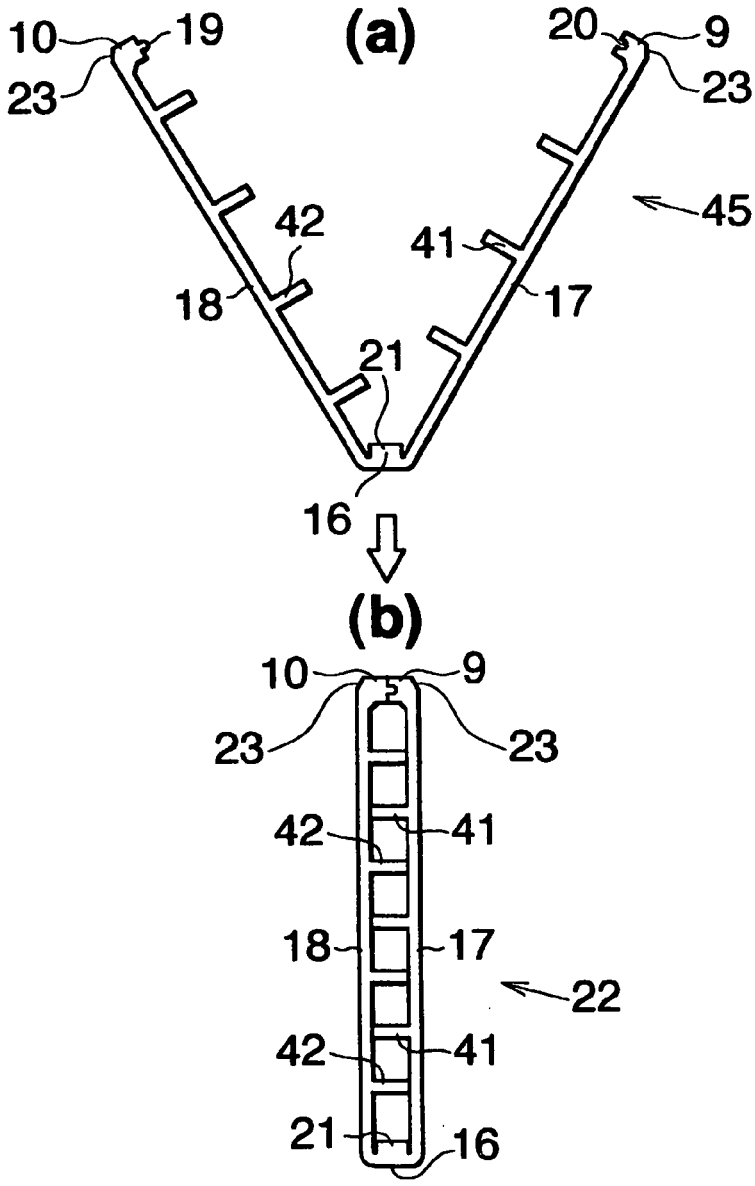
FIG. 9 is a front view showing a method of manufacturing a flat tube using the product of miscellaneous cross section shown in FIG. 8.
Figure 10:
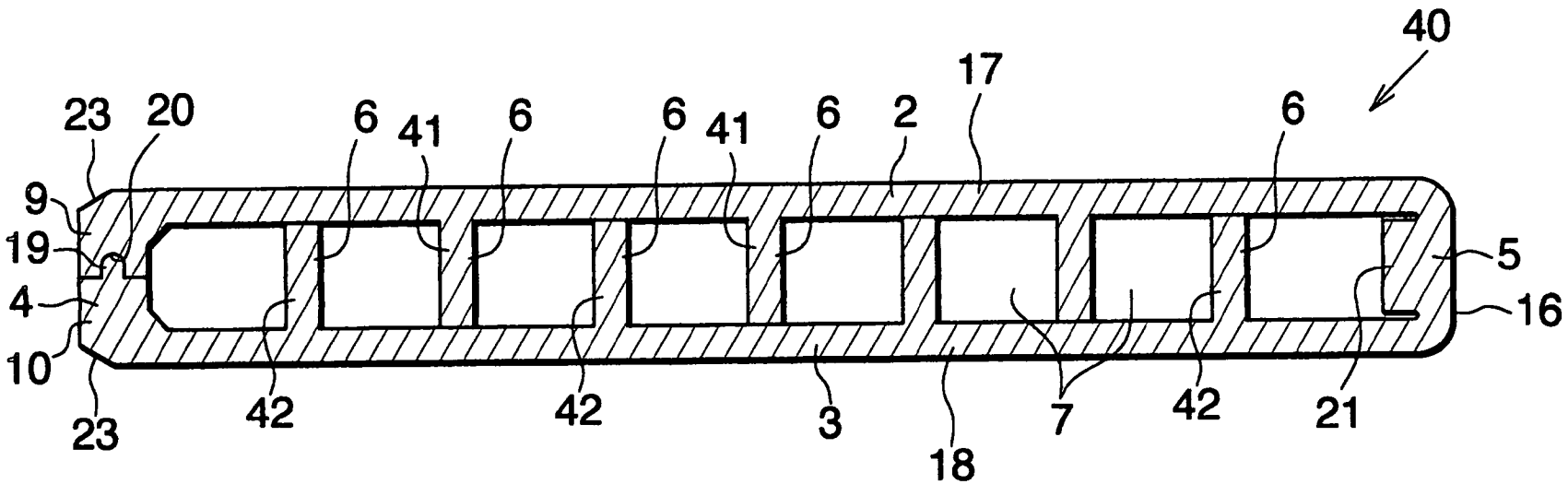
FIG. 10 is a view in cross section showing the flat tube manufactured by the method of FIG. 9.

FIG. 7 shows a rolling apparatus of Embodiment 3, and FIG. 8 shows a product of miscellaneous cross section to be manufactured by the apparatus, i.e., a metal plate for making flat tubes. FIG. 9 shows a method of fabricating the flat tube from the metal plate, and FIG. 10 shows the flat tube fabricated.

First with reference to FIG. 10, the flat tube will be described which is fabricated from the product of miscellaneous cross section to be manufactured by the rolling apparatus of Embodiment 3.

The flat tube 40 has reinforcing walls 6 each comprising a reinforcing wall ridge 41 projecting downward from an upper wall 2 integrally therewith and brazed to a lower wall 3, and reinforcing walls 6 each comprising a reinforcing wall ridge 42 projecting upward from the lower wall 3 integrally therewith and brazed to the upper wall 2, the former walls 6 and the latter walls 6 being arranged alternately laterally. With the exception of this feature, the flat tube 40 is the same as the flat tube 1 already described with reference to Embodiment 1.

The flat tube 40 is fabricated from a metal plate 45 shown in FIG. 8. The metal plate 45 for making the flat tube is in the form of an aluminum brazing sheet having a brazing material layer on opposite sides thereof. The metal plate has reinforcing wall ridges 41, 42 projecting upward from an upper wall forming portion 17 and a lower wall forming portion 18 integrally therewith and arranged laterally at a predetermined spacing, and the reinforcing wall ridges 41 on the upper wall forming portion 17 and the reinforcing wall ridges 42 on the lower wall forming portion 18 are positioned asymmetrically about the center line of the metal plate with respect to the widthwise direction. The ridges 41, 42 have the same height, which is about twice the height of two side wall ridges 9, 10. The reinforcing wall ridges 41, 42 have the same thickness, which is smaller than the thickness of the side wall ridges 9, 10. With the exception of these features, the metal plate 45 is the same as the metal plate 15 described with reference to Embodiment 1. A brazing material layer (not shown) is formed on opposite sides and the outer ends of the ridges 41, 42 as is the case with Embodiment 1. The brazing material layer on the outer ends of the ridges 41, 42 is greater in thickness than the brazing material layer on the other portions.

The flat tube 40 is fabricated by progressively bending the metal plate 45 at the left and right opposite side edges of the connecting portion 16 [see FIG. 9(*a*)], finally bending the plate 15 to the shape of a hairpin to butt the side wall ridges 9, 10 against each other, force the projection 19 into the groove 20, bring the reinforcing wall ridges 41 of the upper wall forming portion 17 into contact with the lower wall forming portion 18 and the reinforcing wall ridges 42 of the lower wall forming portion 18 into contact with the upper wall forming portion 17, and obtain a folded body 22 [see FIG. 9(*b*)] by the roll forming process, and brazing the side wall ridges 9, 10 to each other, the reinforcing wall ridges 41 of the upper wall forming portion 17 to the lower wall forming portion 18 and the reinforcing wall ridges 42 of the lower wall forming portion 18 to the upper wall forming portion 17. At this time, the left side wall 4 is formed by the side wall ridges 9, 10 brazed to each other, the right side wall 5 by the connecting portion 16, the upper wall 2 by the upper wall forming portion 17, the lower wall 3 by the lower wall forming portion 18, and the reinforcing walls 6 by the respective reinforcing wall ridges 41, 42.

In the case where the flat tube 40 is used, for example, as the refrigerant tube 82 of the condenser shown in FIG. 16, such flat tubes 40 may be made simultaneously with the fabrication of the condenser.

Next, the rolling apparatus for manufacturing the metal plate 45 for making the flat tube will be described with reference to FIG. 7. In the case of the rolling apparatus of Embodiment 3, the roll body 27 of a first work roll 46 is made from a cemented carbide such as JIS V10, JIS V20, JIS V30, JISV40, JISV50 or JISV60. The roll body 27 has a plurality of fourth annular grooves 47 formed in its peripheral surface between opposite first annular grooves 29 therein and arranged axially thereof at a spacing for forming reinforcing wall ridges 41, 42. The fourth annular grooves 47 as arranged in the axial direction are asymmetric about the center of the roll body 27, i.e, of the first work roll 46, with respect to the axial direction thereof. All the grooves 47 have the same depth, which is about twice the depth of the first annular groove 29. The fourth annular grooves 47 all have the same width, which is smaller than the width of the first annular groove 29.

The bottom faces of the fourth annular grooves 47 of the first work roll 46 have a radius which is equal to the radius R2 of the cylindrical surface 30 of working surface 34*a* of a second work roll 26, and the two work rolls 46, 26 are rotated at the same number of revolutions. Accordingly, the peripheral speed of the bottom faces of fourth annular grooves 47 of the first work roll 46 is equal to that of the cylindrical surface 30 of working surface 43*a* of the second work roll 26. Incidentally, the peripheral speed of the bottom faces of the fourth annular grooves 47 in the first work roll 46 may be made not smaller than the peripheral speed of the cylindrical surface 30 of working surface 34*a* of the second work roll 26 by making the radius of the bottom faces of the fourth annular grooves 47 in the first work roll 46 not smaller than the radius R2 of the cylindrical surface 30 of working surface 34*a* of the second work roll 26, and rotating the two work rolls 46, 26 at the same number of revolutions.

The metal plate 45 for making the flat tube is manufactured using the rolling apparatus in the same manner as is the case with Embodiment 1. The bottom faces of the fourth annular grooves 47 are inhibited from wearing away as in the case of Embodiment 1.

The roll body 27 of the first work roll 46 of Embodiment 3, like that of Embodiment 2, may comprise a plurality of disks of different diameters stacked on the same straight line to provide the first annular grooves 29, fourth annular grooves 47 and position determining ridge annular groove 32 of the body 27. In this case, the disks providing the bottom faces of the fourth annular grooves 47 by their peripheries are made from a cemented carbide such as JIS V10, JIS V20, JIS V30, JIS V40, JIS V50 or JIS V60. These disks are made to have a radius equal to the radius R2 of the cylindrical surface 30 of working surface 34*a* of the second work roll 26.

Embodiment 4

This embodiment is shown in FIGS. 11 to 14.

Figure 11:
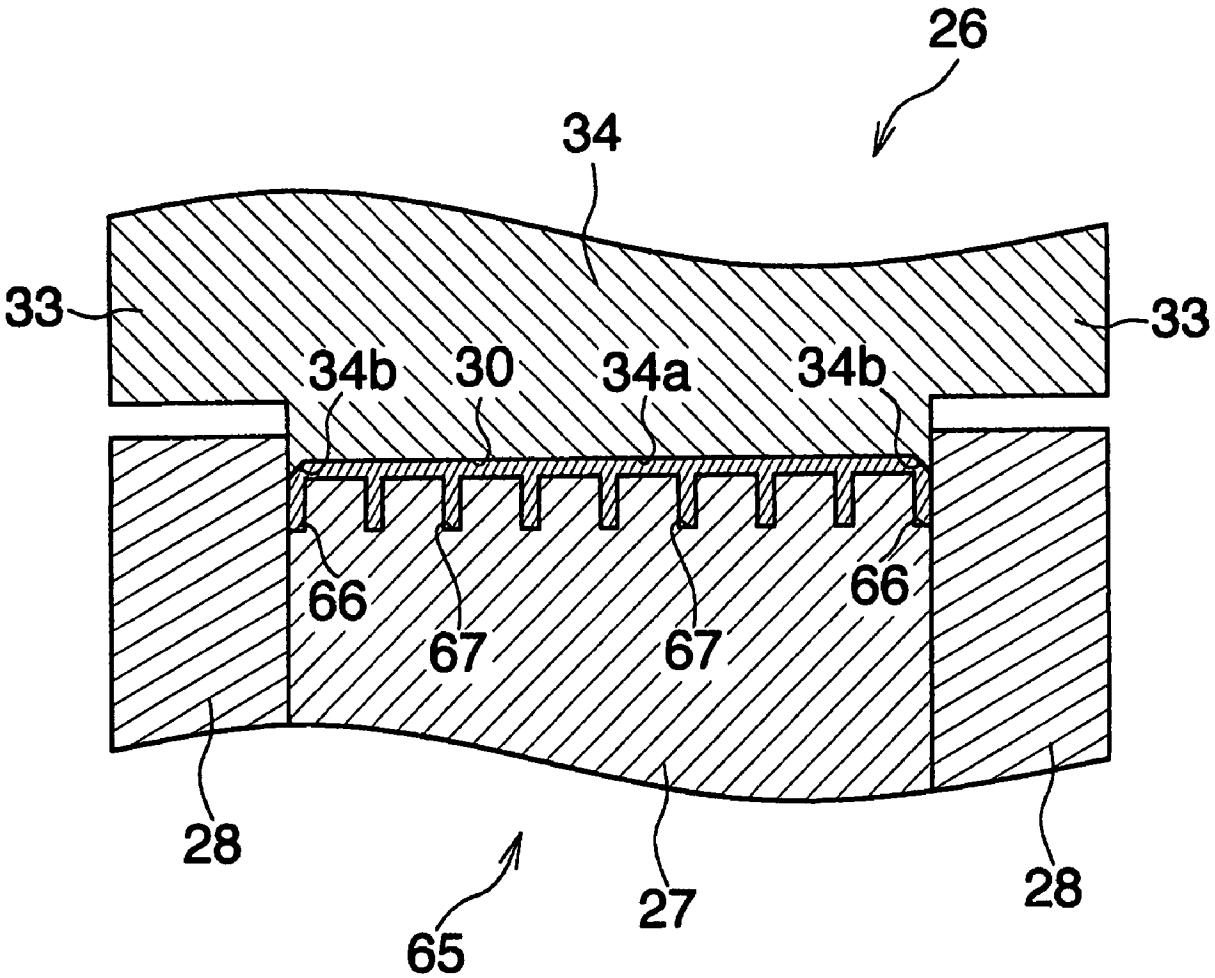
FIG. 11 is a view corresponding to FIG. 2 and showing a rolling apparatus of Embodiment 4 of the invention.
Figure 12:
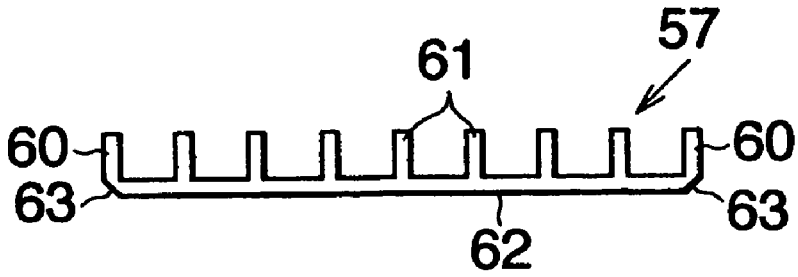
FIG. 12 is a front view of a product of miscellaneous cross section manufactured by the rolling apparatus of FIG. 11.
Figure 13:
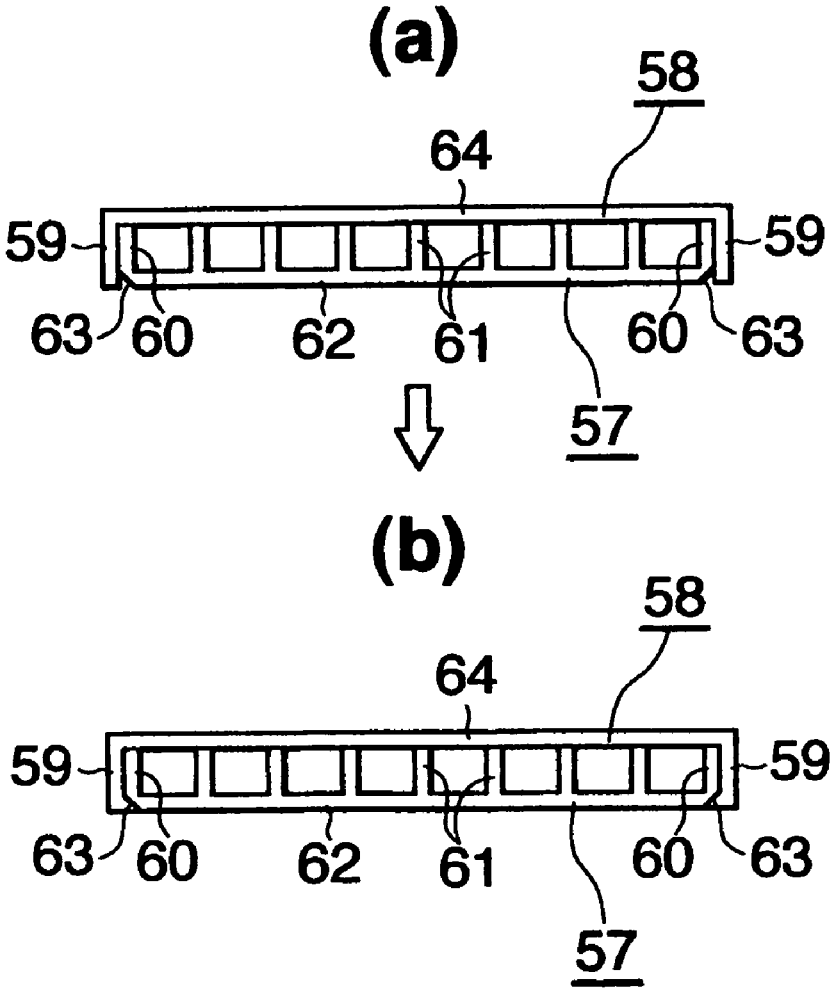
FIG. 13 is a front view showing a method of manufacturing a flat tube using the product of miscellaneous cross section shown in FIG. 12.
Figure 14:
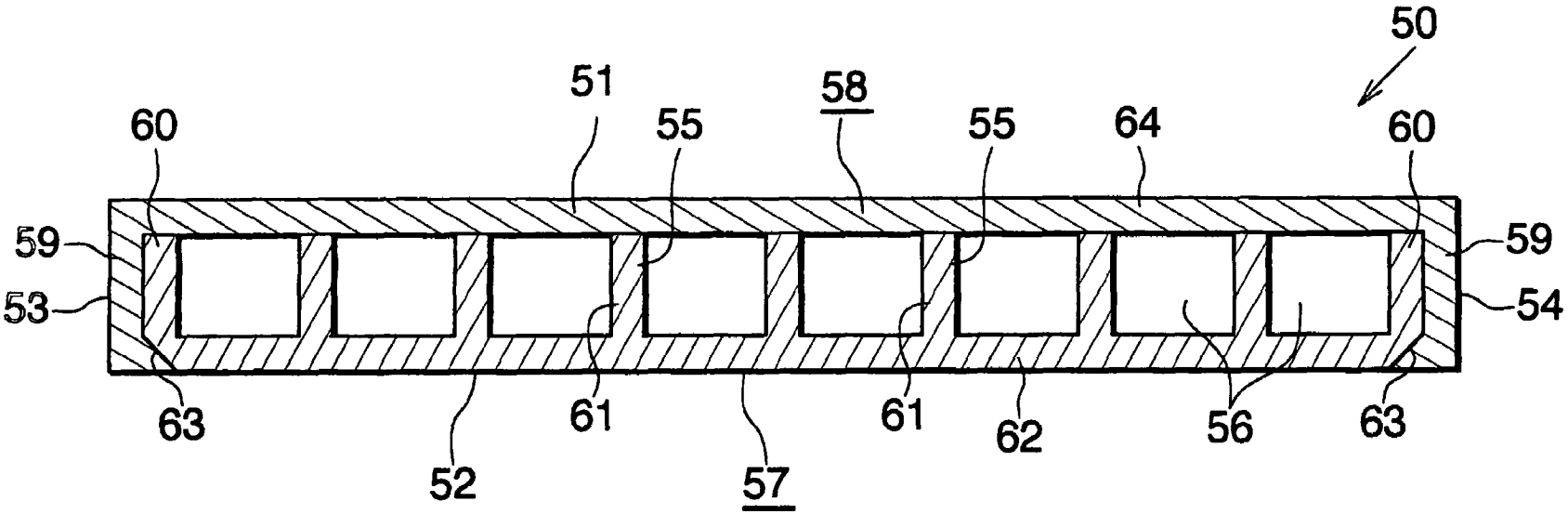
FIG. 14 is a view in cross section showing the flat tube manufactured by the method of FIG. 12.

FIG. 11 shows a rolling apparatus of Embodiment 4, and FIG. 12 shows a product of miscellaneous cross section to be manufactured by the apparatus, i.e., a component member for use in making flat tubes. FIG. 13 shows a method of fabricating the flat tube using the component member, and FIG. 14 shows the flat tube.

First with reference to FIG. 14, the flat tube will be described which is fabricated using the product of miscellaneous cross section to be manufactured by the rolling apparatus of Embodiment 4.

The flat tube 50 comprises flat upper and lower walls 51, 52, left and right opposite side walls 53, 54 of double structure interconnecting the upper and lower walls 51, 52 at the respective left and right side edges thereof, and a plurality of reinforcing walls 55 interconnecting the upper and lower walls 51, 52, extending longitudinally of the tube and spaced from one another as positioned between the left and right side walls 53, 54. The tube 50 has parallel fluid channels 56 formed inside thereof. The flat tube 50 is provided by a lower component member 57 of aluminum constituting the lower wall 52, left and right side walls 53, 54 and reinforcing walls 55, and an upper component member 58 of aluminum plate constituting the upper wall 51 and the left and right side walls 53, 54. Although not shown, each reinforcing wall 55 has a plurality of communication holes for holding adjacent fluid channels 56 in communication with each other. When seen from above, all the communication holes are in a staggered arrangement.

Each of the opposite side walls 53, 54 is made from a downward side wall ridge 59 projecting downward from each of the left and right side edges of the upper wall 51 integrally therewith and an upward side wall ridge 60 projecting upward from each of the left and right side edges of the lower wall 52 integrally therewith, by brazing the ridges 59, 60 as lapped over each other, with the downward ridge 59 positioned on the outer side. The upward ridge 60 has its upper end brazed to the upper wall 51. The reinforcing walls 55 are formed from reinforcing wall ridges 61 projecting upward from the lower wall 52 integrally therewith, by brazing the ridges 61 to the upper wall 51. The upward side wall ridges 60 and all the reinforcing wall ridges 61 have the same thickness and the same height.

The lower component member 57 is the product of miscellaneous cross section to be manufactured by the rolling apparatus of Embodiment 4.

With reference to FIG. 12, the lower component member 57 comprises a flat lower wall forming portion 62, upward side wall ridges 60 projecting upward respectively from opposite side edges of the lower wall forming portion 62 integrally therewith, and a plurality of reinforcing wall ridges 61 projecting upward from the lower wall forming portion 62 integrally therewith, extending longitudinally of the tube and spaced from one another as positioned between the side wall ridges 60. The lower component member 57 has a slope 63 formed at each of opposite side edges of its lower surface and slanting laterally outwardly upward.

As shown in FIG. 13(*a*), the upper component member 58 is made from an aluminum brazing sheet having a brazing material layer on opposite sides thereof by a suitable method such as roll forming, press work or rolling. The upper component member 58 comprises a flat upper wall forming portion 64, and downward side wall ridges 59 downwardly projecting respectively from opposite side edges of the upper wall forming portion 64 integrally therewith and to be lapped over the outer side of the respective side wall ridges 60 of the lower component member 57. The upper wall forming portion 64 of the upper component member 58 has a slightly larger width than the lower component member 57 so that the upper component member 58 is fitted over the member 57.

The upper component member 58 is placed over the lower component member 57 with the downward side wall ridges 59 lapped over the respective upward side wall ridges 60 externally thereof and with the upper ends of the reinforcing wall ridges 61 in contact with the upper wall forming portion 64 of the member 58 [see FIG. 13(*a*)]. The lower ends of the downward side wall ridges 59 are then deformed and brought into intimate contact with the respective slopes 63, whereby the two component members 57, 58 are temporarily held together [see FIG. 13(*b*)]. Each adjacent pairs of side wall ridges 59, 60 are thereafter brazed to each other, the upper ends of the upward side wall ridges 60 and the reinforcing wall ridges 61 to the upper wall forming portion 64, and the deformed portions of the downward side wall ridges 59 to the respective slopes 63. In this way, the flat tube 50 is fabricated. At this time, the left and right side walls 53, 54 are formed by the respective brazed pairs of ridges 59, 60, the upper wall 51 by the upper wall forming portion 64, the lower wall 53 by the lower wall forming portion 62, and the reinforcing walls 55 by the reinforcing wall ridges 61.

In the case where the flat tube 50 is used, for example, as the refrigerant tube 82 of the condenser shown in FIG. 16, such flat tubes 50 may be made simultaneously with the fabrication of the condenser.

Next, the rolling apparatus for manufacturing the lower component member 57 will be described with reference to FIG. 11. In the case of the rolling apparatus of Embodiment 4, the roll body 27 of a first work roll 65 is made from a cemented carbide such as JIS V10, JIS V20, JIS V30, JIS V40, JIS V50 or JIS V60. The roll body 27 is provided in its peripheral surface with first annular grooves 66 formed at opposite ends thereof for making the side wall ridges 60, and with a plurality of second annular grooves 67 formed between the opposite first annular grooves 66 and arranged axially thereof at a spacing for forming reinforcing wall ridges 61. The first annular grooves 66 and all the second annular grooves 67 are equal in depth and in width.

The bottom faces of the first annular grooves 66 and the second annular grooves 67 in the first work roll 65 have a radius which is equal to the radius R2 of the cylindrical surface 30 of working surface 34*a* of a second work roll 26, and the two work rolls 65, 26 are rotated at the same number of revolutions. Accordingly, the peripheral speed of the bottom faces of first annular grooves 66 and the second annular grooves 67 in the first work roll 65 is equal to that of the cylindrical surface 30 of working surface 43*a* of the second work roll 26. Incidentally, the peripheral speed of the bottom faces of the first and second annular grooves 66, 67 in the first work roll 65 may be made not smaller than the peripheral speed of the cylindrical surface 30 of working surface 34*a* of the second work roll 26 by making the radius of the bottom faces of the first and second annular grooves 66, 67 in the first work roll 65 not smaller than the radius R2 of the cylindrical surface 30 of working surface 34*a* of the second work roll 26, and rotating the two work rolls 65, 26 at the same number of revolutions.

The lower component member 57 is manufactured using the rolling apparatus in the same manner as is the case with Embodiment 1. The bottom faces of the first annular grooves 66 and the second annular grooves 67 are inhibited from wearing away as in the case of Embodiment 1.

In the case of Embodiment 4, as in Embodiment 2 described, a plurality of disks of different diameters may be stacked on the same straight line to provide a first work roll having first annular grooves 66 and second annular grooves 67. In this case, the disks providing the bottom faces of the first and second annular grooves 66, 67 by their peripheries are made from a cemented carbide such as JIS V10, JIS V20, JIS V30, JIS V40, JIS V50 or JIS V60. These disks are further made to have a radius equal to the radius R2 of the cylindrical surface 30 of working surface 34*a* of the second work roll 26.

Figure 15:
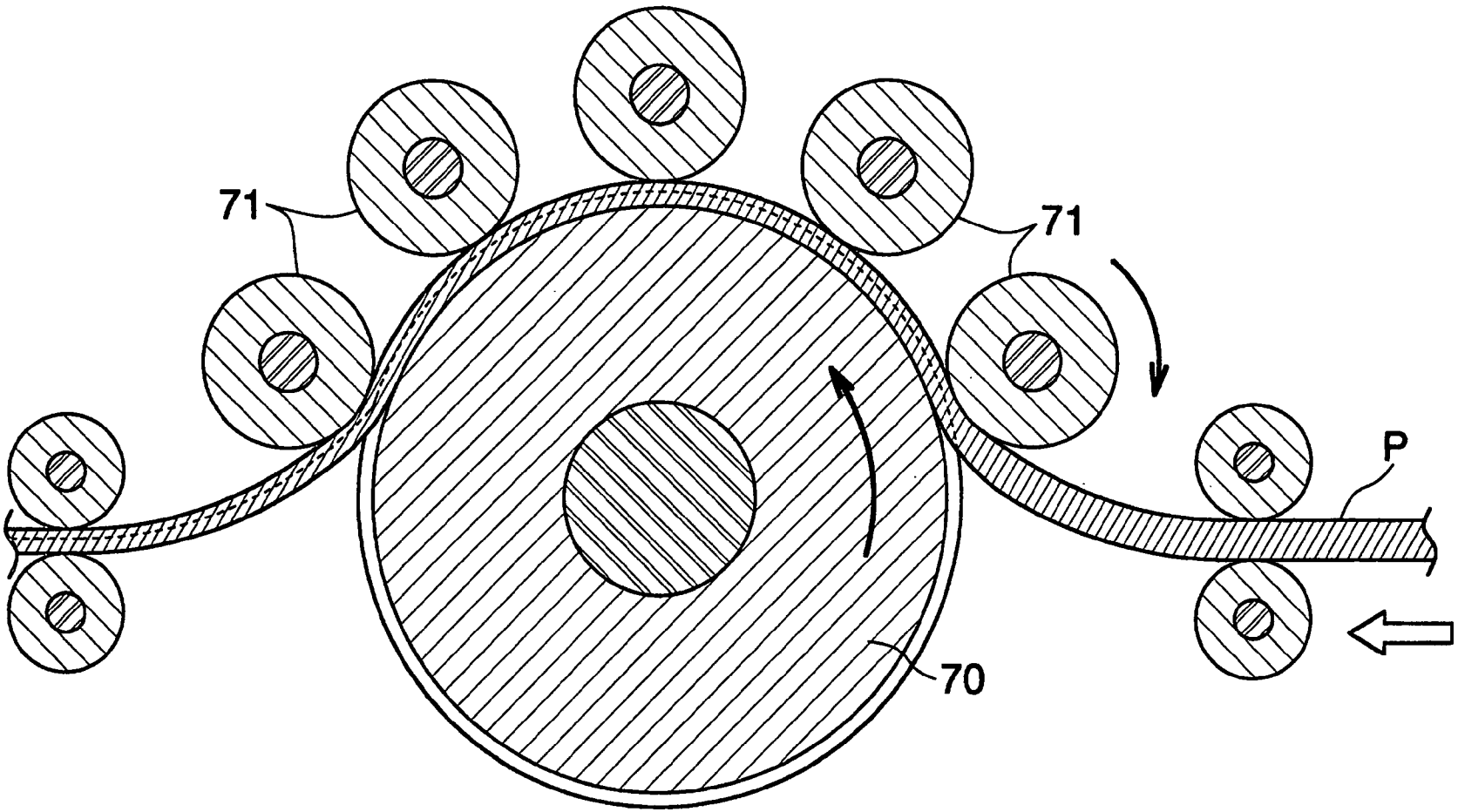
FIG. 15 is a view in vertical section showing another embodiment of rolling apparatus of the invention.

According to Embodiments 1 to 4, the rolling apparatus are of the type wherein a single second work roll 26 is provided for a single first work roll 25, 35, 46 or 65, but this arrangement is not limitative; the invention is applicable also to a so-called satellite rolling apparatus wherein a plurality of second work rolls 71 are arranged around a single first work roll 70 circumferentially thereof at a spacing as seen in FIG. 15. In this case, the first work roll 70 has the same construction as the first work roll 25, 35, 46 or 65 of one of Embodiments 1 to 4. Although the diameter of the second work rolls 71 is smaller than the diameter of the first work roll 70, the first roll 70 is different from the second rolls 71 in the number of revolutions when rotated so that the peripheral speed of the bottom faces of the deepest ridge forming annular grooves is not smaller than the peripheral speed of the working surfaces of the second work rolls 71 other than the slope forming portions thereof.

INDUSTRIAL APPLICABILITY

The invention provides a rolling apparatus suitable for manufacturing a metal product of miscellaneous cross section which comprises a plate portion having a flat surface on one side thereof and a plurality of ridges extending upright from the other side of the plate portion integrally therewith and spaced from one another.

The invention claimed is:

1. A rolling apparatus comprising a single first work roll and a single second work roll cooperative with the first work roll for rolling a metal blank plate to manufacture a metal product of miscellaneous cross section comprising a plate portion and a plurality of ridges projecting upright from only one side of the plate portion integrally therewith and spaced from one another, the first work roll having a plurality of ridge forming annular grooves formed in a peripheral surface of the first work roll over an entire circumference of the peripheral surface of the first work roll and arranged at a spacing axially of the first work roll, a portion of a peripheral surface of the second work roll other than axial opposite end portions thereof is in the form of a cylindrical surface, a bottom face of a deepest of all the ridge forming annular grooves in the first work roll having a diameter not smaller than a diameter of the cylindrical surface of the second work roll, the two work rolls being rotatable at a same number of revolutions so that a peripheral speed of the bottom face of the deepest of all the ridge forming annular grooves in the first work roll is not smaller than a peripheral speed of the cylindrical surface of the second work roll.

2. A rolling apparatus according to claim 1 wherein the bottom face of the deepest ridge forming annular groove in the entire first work roll has a surface layer made of a cemented carbide.

3. A rolling apparatus according to claim 1 wherein the first work roll comprises a roll body, and a flange fixed to each of opposite ends of the roll body and having a larger diameter than the roll body, the roll body being made of a cemented carbide, the plurality of ridge forming annular grooves being formed in a peripheral surface of the roll body.

4. A rolling apparatus according to claim 1 wherein the first work roll is made of a cemented carbide in its entirety.

5. A rolling apparatus according to claim 1 wherein the first work roll comprises a plurality of disks stacked on a straight line and having different diameters, and a pair of flanges arranged at opposite ends of the stack of disks and fixedly holding the disks together, each of the disks having an outer peripheral surface serving as a working surface, the disks including large-diameter disks positioned at portions where no ridges are to be formed and small-diameter disks arranged at portions where the respective ridges are to be formed and smaller in diameter than the large-diameter disks by an amount corresponding to the height of the ridges, the ridge forming annular grooves being provided at the respective portions where the small-diameter disks are arranged.

6. A rolling apparatus according to claim 5 wherein the small-diameter disks are made of a cemented carbide.

7. A rolling apparatus according to claim 1 wherein the ridge forming annular grooves are an even number of at least 2 in number, and all the ridge forming annular grooves as arranged axially of the first work roll are symmetric about a center of the first work roll with respect to the axial direction thereof.

8. A rolling apparatus according to claim 7 wherein all the ridge forming annular grooves are equal in depth.

9. A rolling apparatus according to claim 7 wherein a pair of ridge forming annular grooves symmetric to each other are equal to each other in width.

10. A rolling apparatus according to claim 9 wherein the ridge forming annular grooves are an even number of at least 4 in number, and all the ridge forming annular grooves other than the two ridge forming annular grooves positioned respectively at opposite ends are equal in width, the two ridge forming annular grooves positioned at opposite ends having a larger width than the other ridge forming annular grooves.

11. A rolling apparatus according to claim 1 wherein the ridge forming annular grooves are at least 3 in number, and the two ridge forming annular grooves as arranged at axial opposite ends of the first work roll are symmetric about a center of the first work roll with respect to the axial direction thereof, the other ridge forming annular groove or grooves being provided between said two ridge forming annular grooves.

12. A rolling apparatus according to claim 11 wherein the ridge forming annular grooves are at least 4 in number, and the ridge forming annular grooves other than the two ridge forming annular grooves positioned respectively at opposite ends are asymmetric about the center of the first work roll with respect to the axial direction thereof.

13. A rolling apparatus according to claim 11 wherein the two ridge forming annular grooves positioned respectively at opposite ends are equal to each other in depth, and the other ridge forming annular grooves are equal in depth, the two ridge forming annular grooves at respective opposite ends having a smaller depth than the other ridge forming annular grooves.

14. A rolling apparatus according to claim 11 wherein the two ridge forming annular grooves positioned respectively at opposite ends are equal to each other in width.

15. A rolling apparatus according to claim 14 wherein all the ridge forming annular grooves other than the two ridge forming annular grooves positioned respectively at opposite ends are equal in width, and the two ridge forming annular grooves positioned at opposite ends have a larger width than the other ridge forming annular grooves.

16. A rolling apparatus according to claim 1 wherein all the ridge forming annular grooves are equal in depth.

17. A rolling apparatus according to claim 16 wherein the ridge forming annular grooves are at least 3 in number, and the two ridge forming annular grooves positioned respectively at opposite ends are equal to each other in width.

18. A method of manufacturing a product of miscellaneous cross section characterized by passing a metal blank plate between the first and second work rolls of a rolling apparatus according to claim 1.

19. A method of manufacturing a product of miscellaneous cross section according to claim 18 wherein the metal blank plate comprises an aluminum brazing sheet having a brazing material layer on at least one side thereof to be provided with the ridges.

20. A rolling apparatus comprising a first work roll and a second work roll cooperative with the first work roll for rolling a metal blank plate to manufacture a metal product of miscellaneous cross section comprising a plate portion and a plurality of ridges projecting upright from one side of the plate portion integrally therewith and spaced from one another, the first work roll having a plurality of ridge forming annular grooves formed in a peripheral surface of the first work roll over an entire circumference of the peripheral surface of the first work roll and arranged at a spacing axially of the first work roll, the two work rolls being rotatable so that a peripheral speed of a bottom face of a deepest of all the ridge forming annular grooves in the first work roll is not smaller than a peripheral speed of a peripheral surface of the second work roll, wherein the ridge forming annular grooves are an even number of at least 2 in number, and all the ridge forming annular grooves as arranged axially of the first work roll are symmetric about a center of the first work roll with respect to the axial direction thereof, and wherein the peripheral surface of the first work roll has an annular groove formed at an axial center of the first work roll over an entire circumference of the axial center and having a larger width and a smaller depth than the ridge forming annular grooves.

21. A rolling apparatus comprising a first work roll and a second work roll cooperative with the first work roll for rolling a metal blank plate to manufacture a metal product of miscellaneous cross section comprising a plate portion and a plurality of ridges projecting upright from one side of the plate portion integrally therewith and spaced from one another, the first work roll having a plurality of ridge forming annular grooves formed in a peripheral surface of the first work roll over an entire circumference of the peripheral surface of the first work roll and arranged at a spacing axially of the first work roll, the two work rolls being rotatable so that a peripheral speed of a bottom face of a deepest of all the ridge forming annular grooves in the first work roll is not smaller than a peripheral speed of a peripheral surface of the second work roll, wherein the ridge forming annular grooves are at least 3 in number, and the two ridge forming annular grooves as arranged at axial opposite ends of the first work roll are symmetric about a center of the first work roll with respect to the axial direction thereof, the other ridge forming annular groove or grooves being provided between said two ridge forming annular grooves, and wherein the peripheral surface of the first work roll has an annular groove formed at an axial center of the first work roll over an entire circumference of the axial center and having a larger width and a smaller depth than the ridge forming annular grooves.

22. A rolling apparatus comprising a first work roll and a second work roll cooperative with the first work roll for rolling a metal blank plate to manufacture a metal product of miscellaneous cross section comprising a plate portion and a plurality of ridges projecting upright from one side of the plate portion integrally therewith and spaced from one another, the first work roll having a plurality of ridge forming annular grooves formed in a peripheral surface of the first work roll over an entire circumference of the peripheral surface of the first work roll and arranged at a spacing axially of the first work roll, the two work rolls being rotatable so that a peripheral speed of a bottom face of a deepest of all the ridge forming annular grooves in the first work roll is not smaller than a peripheral speed of a peripheral surface of the second work roll, wherein the ridge forming annular grooves are an even number of at least 2 in number, and all the ridge forming annular grooves as arranged axially of the first work roll are symmetric about a center of the first work roll with respect to the axial direction thereof, and wherein one of the two ridge forming annular grooves positioned respectively at opposite ends is provided in a bottom face thereof with an annular furrow over the entire circumference for forming a projection, and the other of the two ridge forming annular grooves at the ends is provided on a bottom face thereof with an annular projection over the entire circumference for forming a groove for the projection to be formed by the annular furrow to fit in.

23. A rolling apparatus comprising a first work roll and a second work roll cooperative with the first work roll for rolling a metal blank plate to manufacture a metal product of miscellaneous cross section comprising a plate portion and a plurality of ridges projecting upright from one side of the plate portion integrally therewith and spaced from one another, the first work roll having a plurality of ridge forming annular grooves formed in a peripheral surface of the first work roll over an entire circumference of the peripheral surface of the first work roll and arranged at a spacing axially of the first work roll, the two work rolls being rotatable so that a peripheral speed of a bottom face of a deepest of all the ridge forming annular grooves in the first work roll is not smaller than a peripheral speed of a peripheral surface of the second work roll, wherein the ridge forming annular grooves are at least 3 in number, and the two ridge forming annular grooves as arranged at axial opposite ends of the first work roll are symmetric about a center of the first work roll with respect to the axial direction thereof, the other ridge forming annular groove or grooves being provided between said two ridge forming annular grooves, and wherein one of the two ridge forming annular grooves positioned respectively at opposite ends is provided in a bottom face thereof with an annular furrow over the entire circumference for forming a projection, and the other of the two ridge forming annular grooves at the ends is provided on a bottom face thereof with an annular projection over the entire circumference for forming a groove for the projection to be formed by the annular furrow to fit in.

* * * * *